US011352809B2

(12) United States Patent
Taylor et al.

(10) Patent No.: US 11,352,809 B2
(45) Date of Patent: Jun. 7, 2022

(54) AUTOMATED FENCE PULLING ASSEMBLY

(71) Applicant: Marion Mechanical LLC, Millersport, OH (US)

(72) Inventors: Todd Taylor, Millersport, OH (US); Mitch Marion, Millersport, OH (US)

(73) Assignee: Marion Mechanical LLC, Millersport, OH (US)

( * ) Notice: Subject to any disclaimer, the term of this patent is extended or adjusted under 35 U.S.C. 154(b) by 0 days.

(21) Appl. No.: 16/991,755

(22) Filed: Aug. 12, 2020

(65) Prior Publication Data

US 2021/0140195 A1 May 13, 2021

Related U.S. Application Data

(60) Provisional application No. 62/885,521, filed on Aug. 12, 2019.

(51) Int. Cl.
*E04H 17/00* (2006.01)
*E04H 17/26* (2006.01)

(52) U.S. Cl.
CPC ..... *E04H 17/266* (2013.01)

(58) Field of Classification Search
CPC ..... E04H 17/266; E04H 17/127; B65H 75/40; B65H 75/4402; B65H 75/4421; B65H 75/4439
See application file for complete search history.

(56) References Cited

U.S. PATENT DOCUMENTS 3,048,348 A * 8/1962 Griffin ..... E04H 17/266 242/422.5
3,394,903 A * 7/1968 Rom ..... E04H 17/266 242/390.5
4,930,718 A * 6/1990 Lancour ..... B65H 49/32 242/557
5,163,634 A * 11/1992 Moon ..... E04H 17/266 140/123.5
5,582,216 A * 12/1996 Smith ..... B21F 33/00 140/107
5,806,779 A * 9/1998 Crum ..... E04H 17/266 242/399.1
6,042,046 A * 3/2000 Beyer, Sr. ..... B65H 49/32 242/399.1
2004/0227031 A1* 11/2004 Yoder ..... E04H 17/266 242/390.5
2009/0014578 A1* 1/2009 Beem ..... E04H 17/266 242/557

* cited by examiner

*Primary Examiner* — Emmanuel M Marcelo
(74) *Attorney, Agent, or Firm* — Standley Law Group LLP; Beverly A. Marsh; Kenny W. Pung

(57) ABSTRACT

A fence pulling assembly that includes a mount plate, a support frame, a spindle, a brace post, a press bar, and an actuator. The support frame extends from the mount plate and is connected to the spindle and the brace post. The spindle receives a roll of fencing. The brace post supports the press bar. The press bar is pivotable between a first position and a second position, wherein the distance between the press bar and the spindle is greater in the first position than in the second position. The actuator is configured to move the press bar between the first position and the second position.

16 Claims, 16 Drawing Sheets

AUTOMATED FENCE PULLING ASSEMBLY

CROSS-REFERENCE TO RELATED APPLICATIONS

This application is a nonprovisional patent application and makes a priority claim to U.S. provisional patent application Ser. No. 62/885,521, filed on Aug. 12, 2019. The contents of provisional patent application Ser. No. 62/885,521 are incorporated by reference as if fully recited herein.

TECHNICAL FIELD

Exemplary embodiments relate generally to systems and methods for transporting, pulling, and stretching rolls of woven wire fencing.

BACKGROUND

Woven wire fencing is often used to contain livestock or other animals in a certain location, as well as to keep them safe from outside predators. Woven wire fencing is typically purchased in rolls that must be stretched out before they can be nailed, stapled, or otherwise secured to fence posts. A common difficulty when creating a woven wire fence is to be able to stretch the woven wire prior to securing it to each post so that it has a smooth appearance, does not sag and cause a lower fence height, and can be tightly secured to the posts. Because woven wire is made from metal (typically a steel mesh), rolls of woven wire can be very heavy and cumbersome to transport, unroll, and stretch out across fence posts or other objects during installation.

SUMMARY OF THE INVENTION

Disclosed are apparatus and methods for pulling fences, especially woven wire fences.

In one embodiment, the fence pulling assembly includes a mount plate, a support frame, a spindle, a brace post, a press bar, and an actuator. The mount plate includes a first major side and a second major side, wherein the first major side is configured to interface with a loader. The support frame extends from the second major side of the mount plate, wherein the support frame includes a distal end and is configured to support the weight of a roll of fencing. The spindle is connected to the support frame and is configured to receive a roll of fencing. The brace post is connected to the support frame and is configured to support the weight of a press bar. The press bar is pivotable about the brace post between at least a first position and a second position, wherein the distance between the press bar and the spindle is greater in the first position than in the second position. The actuator is connected to the support frame and the press bar, wherein the actuator is configured to move the press bar between at least the first position and the second position.

In another embodiment, the fence pulling assembly includes a spindle, a brace post, a pair of brackets, a press bar, and a hydraulic cylinder. The spindle is configured to receive a roll of fencing. The brace post is configured to support the weight of a press bar. Each bracket is connected to the brace post. The press bar is connected to each bracket of the pair of brackets and is pivotable about the brace post between at least a first position and a second position, wherein the distance between the press bar and the spindle is greater in the first position than in the second position. The hydraulic cylinder is connected to the support frame and the press bar, and is configured to move the press bar between at least the first position and the second position.

In yet another embodiment, a method of fence pulling is provided that includes: connecting a spindle to a loader; loading a roll of fencing onto a spindle; unraveling a length of fencing from the roll of fencing; attaching a portion of the fencing to a structure; actuating an actuator to move a press bar such that the press bar presses against the roll of fencing; and moving the roll of fencing away from the structure.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
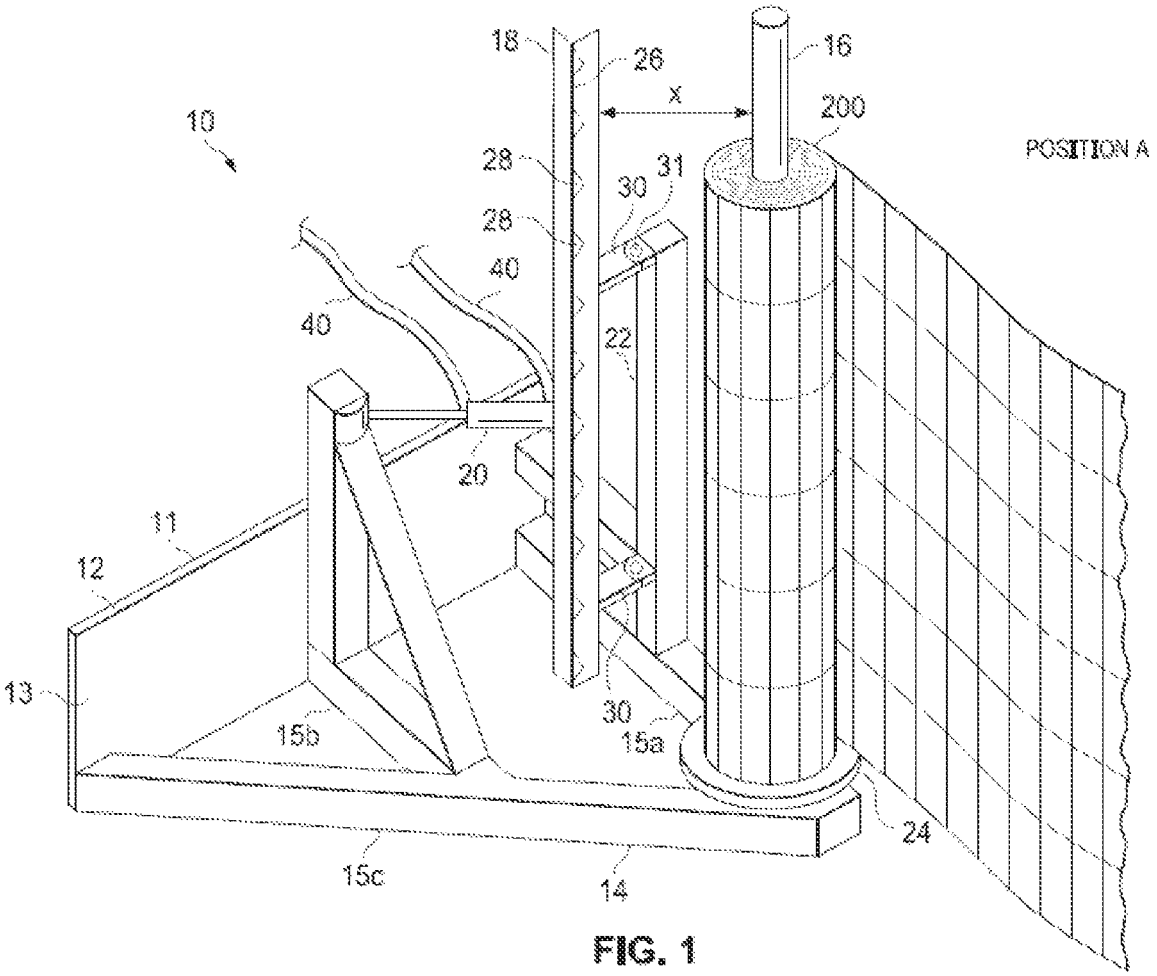
FIG. 1 is a left side perspective view of a first exemplary embodiment of a fence pulling assembly with the press bar in a first position ("Position A")
Figure 2:
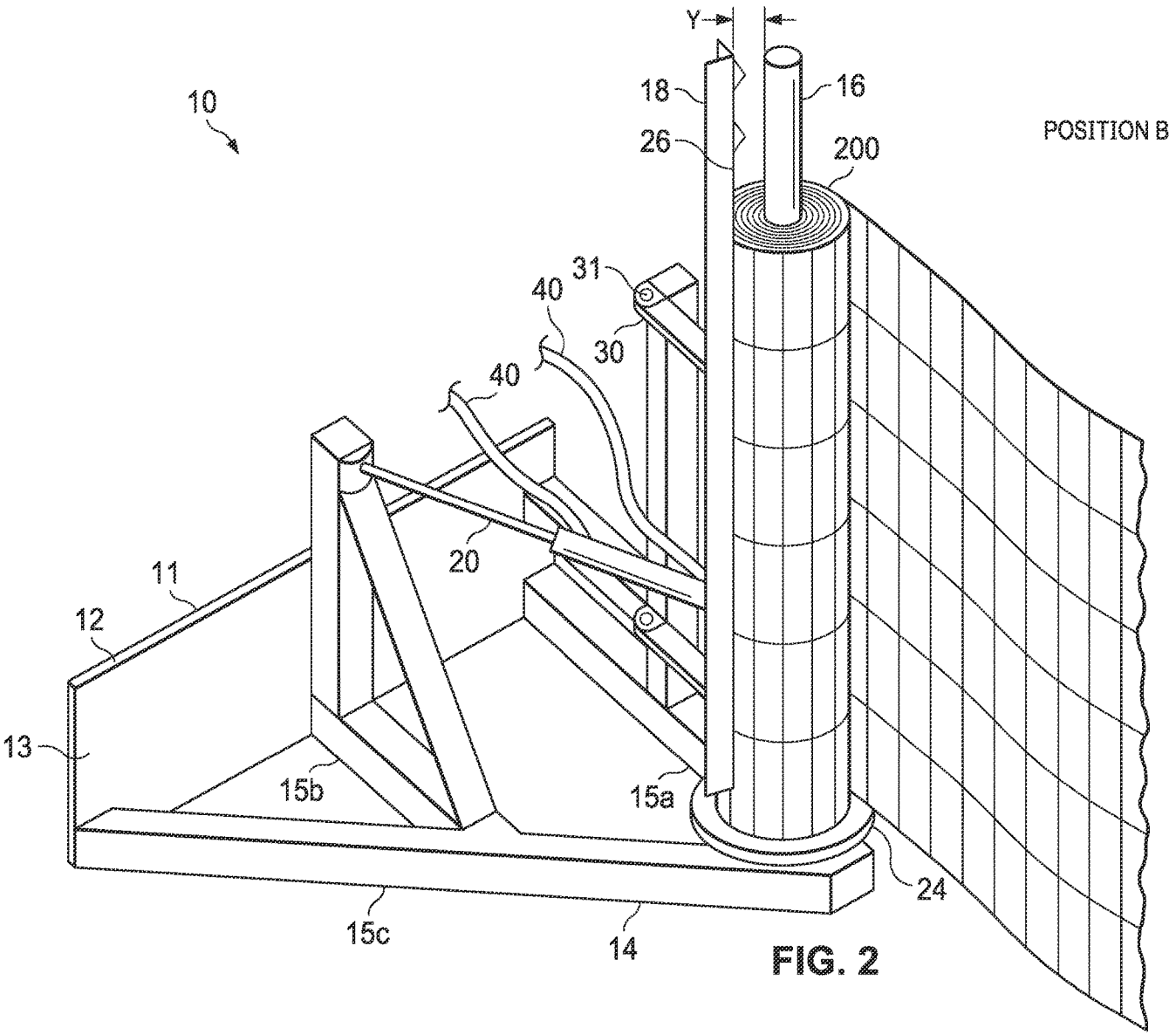
FIG. 2 is a left side perspective view of the exemplary embodiment of FIG. 1 with the press bar in a second position ("Position B")
Figure 3:
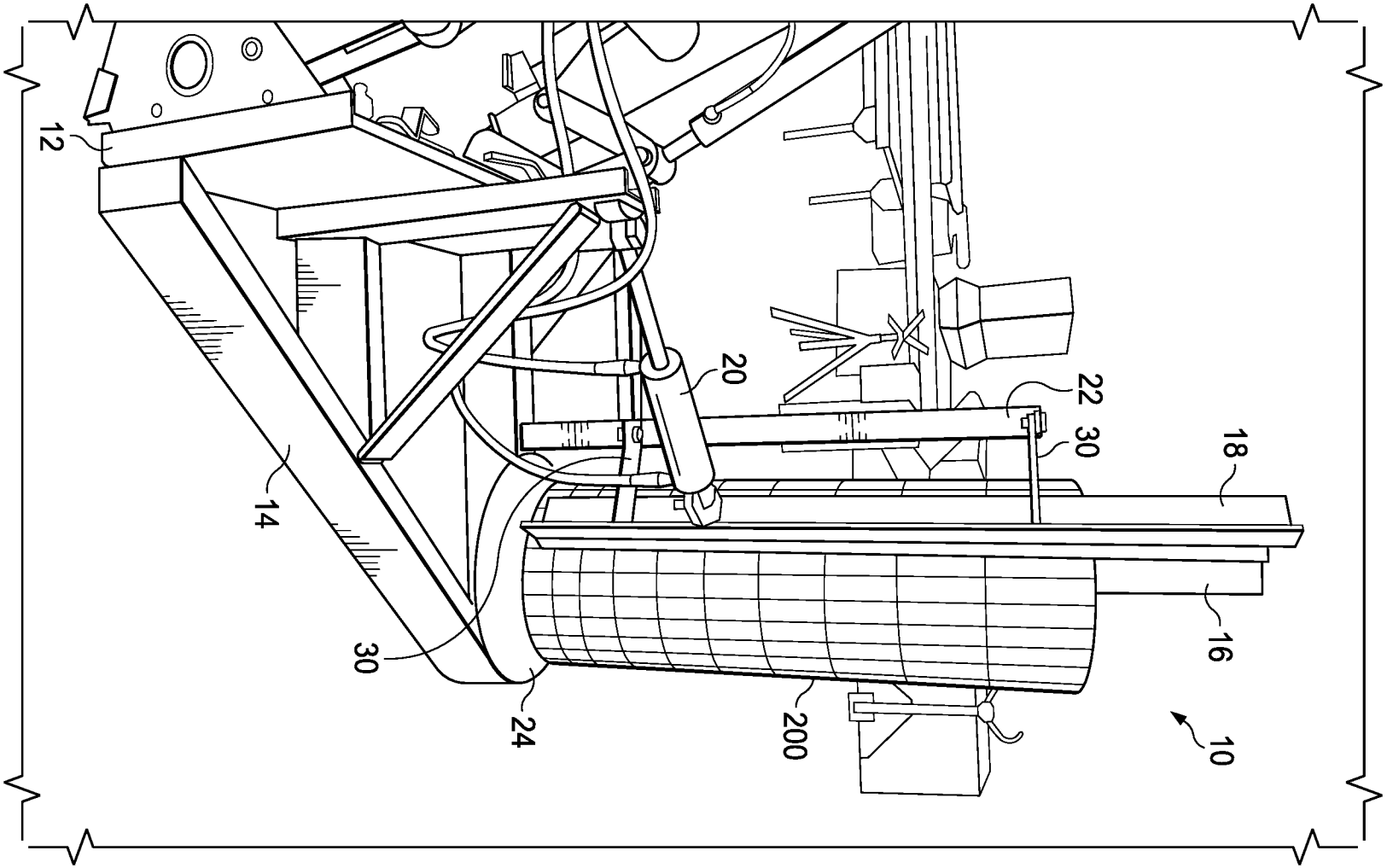
FIG. 3 is a left side perspective view of the exemplary embodiment of FIG. 1, shown connected to a skid steer.
Figure 4:
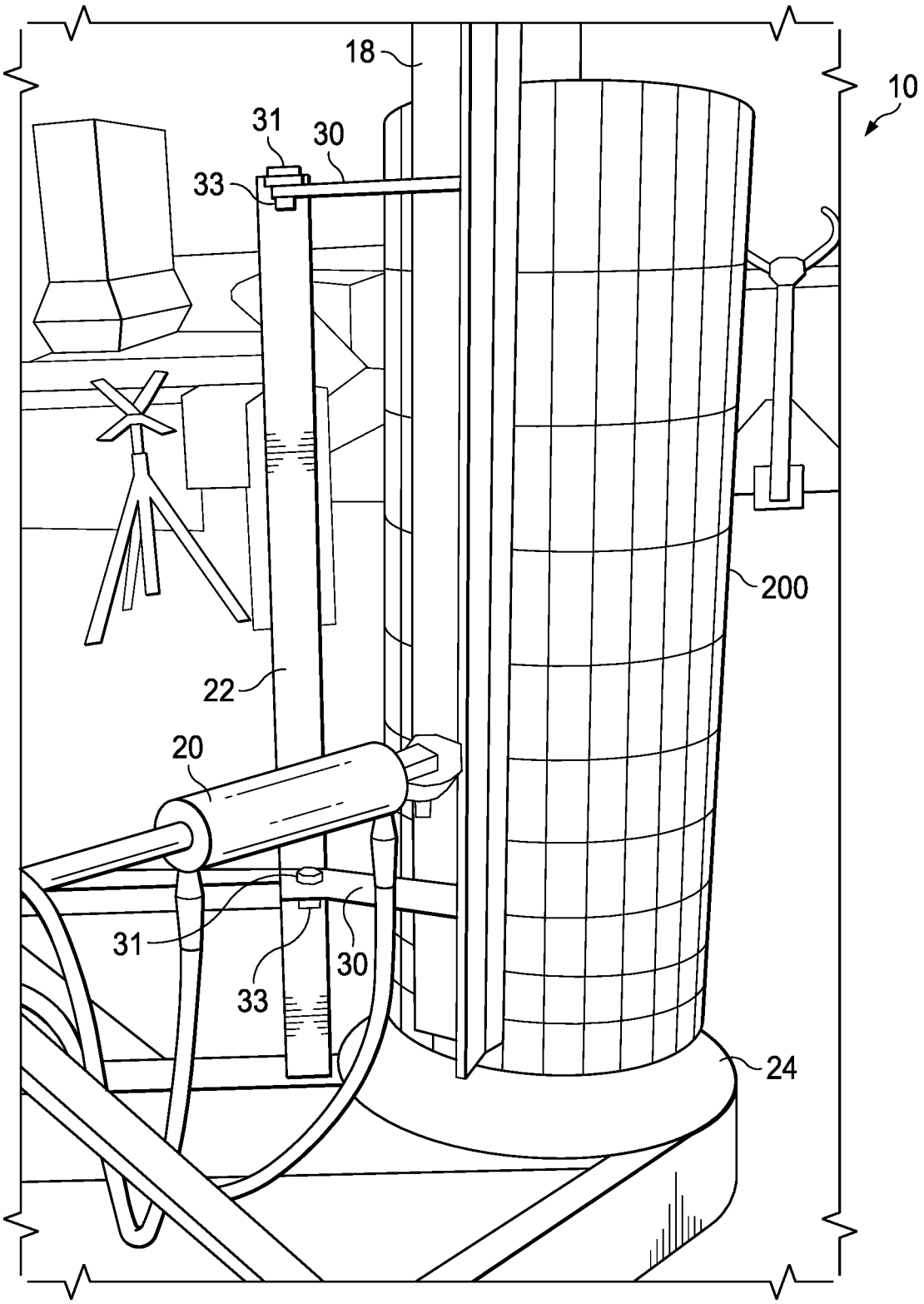
FIG. 4 is a close up view of a portion of FIG. 3.
Figure 5:
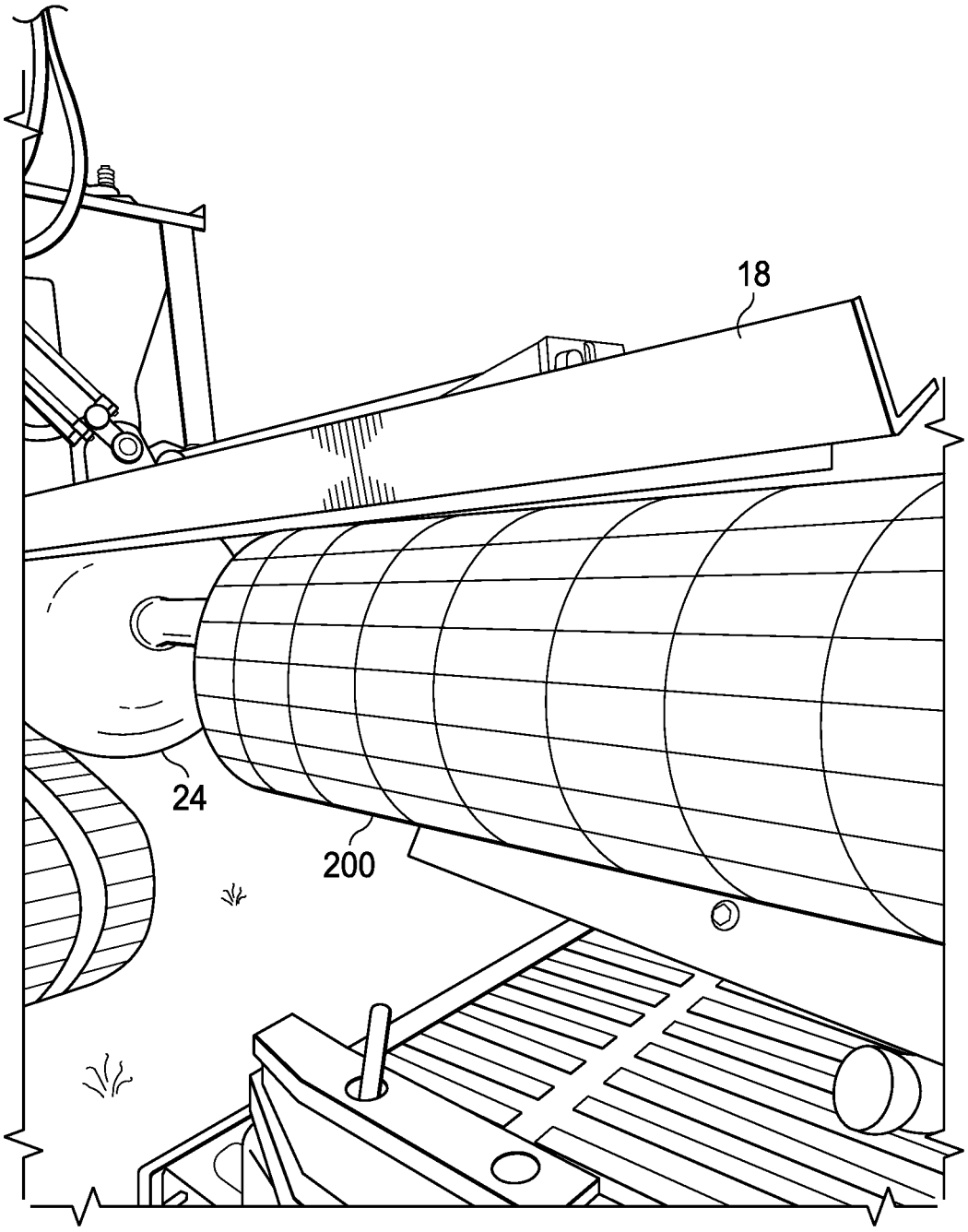
FIG. 5 is a perspective view of the exemplary embodiment of FIG. 1 being used to pick up a roll of fencing.
Figure 6:
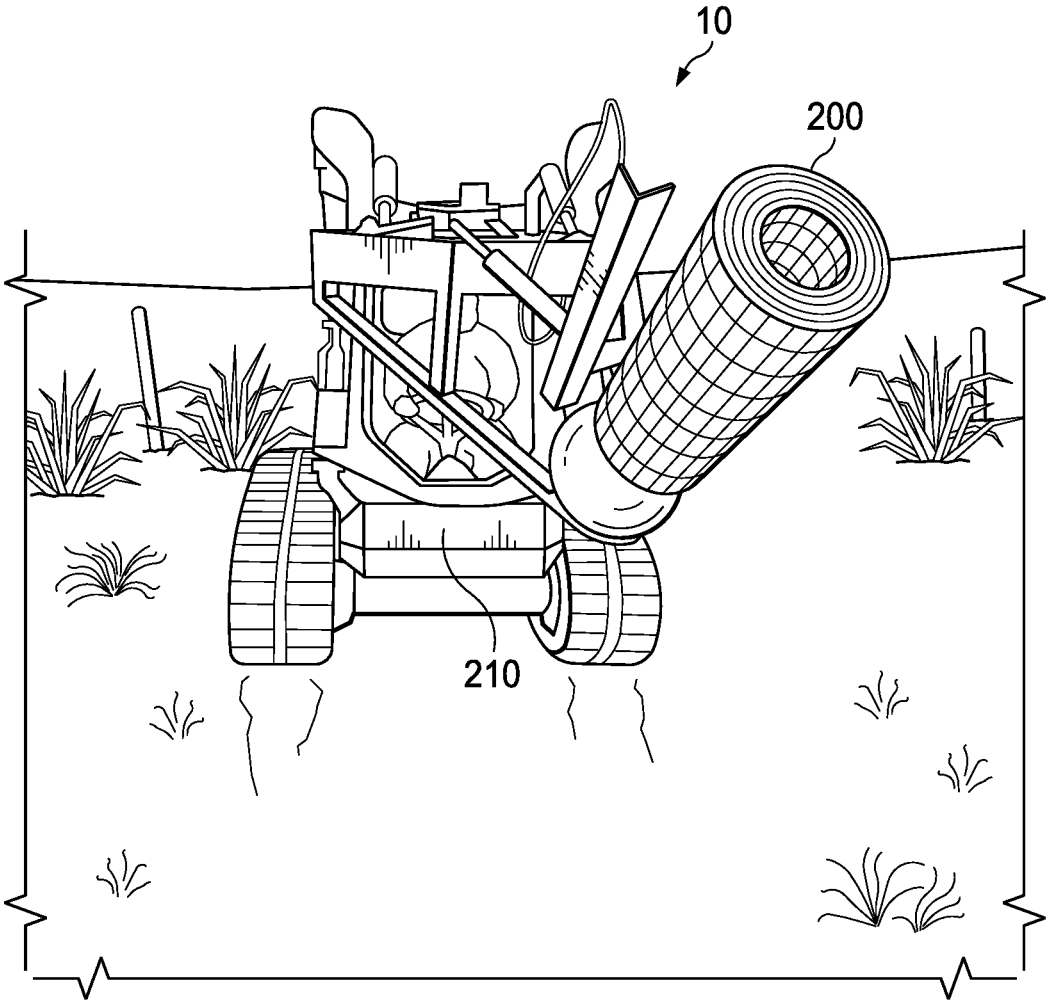
FIG. 6 is an environmental view showing a skid steer using the exemplary embodiment of FIG. 1 to transport a roll of fencing.
Figure 7:
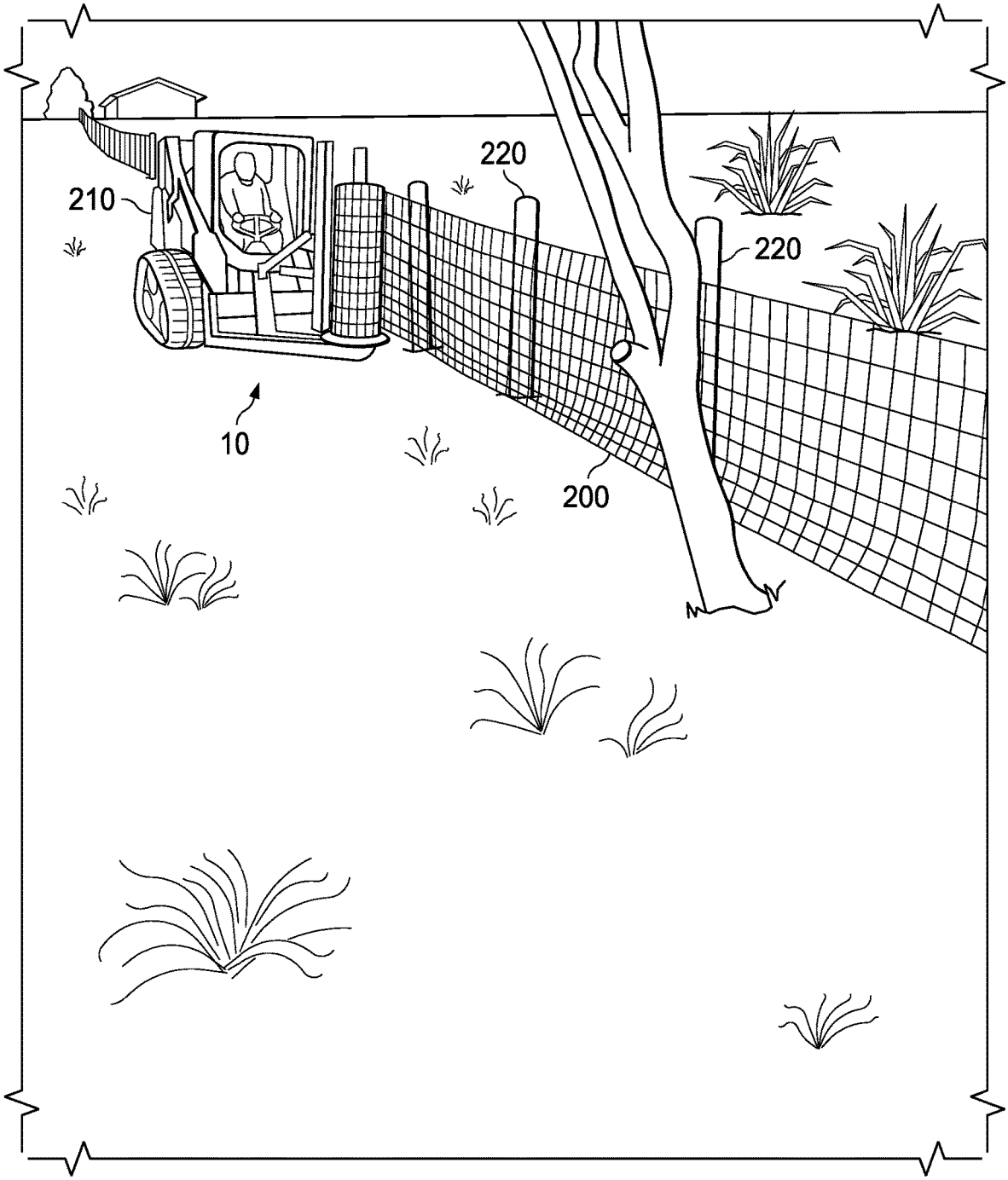
FIG. 7 is an environmental view showing a roll of fencing being installed using the exemplary embodiment of FIG. 1.

Referring to FIGS. 1-7, the present disclosure provides an example of an assembly 10 for transporting, pulling, and stretching woven wire fencing. More specifically, by loading a roll of fencing 200 onto the assembly 10 and coupling the assembly 10 to a skid steer 210, the skid steer 210 may lift the roll of fencing 200 and transport it to a desired location. At which point, the assembly 10 may then be used to unravel the roll of fencing 200 while maintaining tension along the length of the fencing such that the fencing may be attached to a fence post, or some other suitable structure, without sagging.

The assembly 10 includes a mount plate 12, a support frame 14, and a spindle 16. The mount plate 12 enables the assembly 10 to be coupled to a skid steer 210, while the support frame 14 serves as a base to support the spindle 16 (in addition to other components, described below). The spindle 16 may be used to receive the roll of fencing 200, and to maneuver the roll 200 as the fencing is being unraveled and/or transported.

The size, shape, and coupling features (not shown) of the mount plate 12 are not meant to be limiting, and may be varied as needed to accommodate skid steers 210, loaders, and/or other machinery of ostensibly any suitable variety. As shown, however, the mount plate 12 may be generally rectangular in shape, having a first major side 11 that includes coupling features for interfacing with a skid steer 210 (e.g., by way of conventional pins and notches), and a second major side 13 where the support frame 14 may extend therefrom (shown as being disposed primarily along the bottom).

In the configuration shown, the mount plate 12 and the support frame 14 may define a generally triangular configuration (more specifically, a right triangle) along the bottom of the assembly 10. The support frame 14 includes two orthogonal components 15*a*, 15*b*, one longer than the other, that extend outwards from the second major side 13 of the mount plate 12, and a diagonal component 15*c* connected to the distal ends of the orthogonal components 15*a*, 15*b*. The spindle 16 may be disposed along the distal end of the longest orthogonal component 15*a*, at a vertex of the triangle configuration. As those skilled in the art will appreciate, this configuration may enable a skid steer 210 to position the roll of fencing 200 close to a fence post, or some other suitable structure, from along the side of the skid steer 210 (as opposed to approaching the fence post head-on). Of course, other configurations of the mount plate 12 and the support frame 14 (e.g., non-triangular shapes) may also be utilized without departing from the scope of the present disclosure.

The spindle 16 is sized to accommodate a roll of fencing 200, and is preferably longer than a roll of fencing 200 in order to provide proper support. At the base of the spindle 16 may be a flange 24 sized to accommodate a roll of fencing 200 on its top surface. The flange 24 may include a circular, flat surface or a surface of another shape to provide such support. Both the spindle 16 and flange 24 are fixedly attached to the support frame 14. However, in some embodiments the flange 24 may be free to rotate around the bottom of the spindle 16. In other embodiments, the spindle 16 may be removable and/or adjustable to change the height.

In addition to the mount plate 12, the support frame 14, and the spindle 16, the assembly may also include a press bar 18, an actuator 20, and a brace post 22. The brace post 22 is connected to the support frame 14 (shown as being connected at the bottom and along its side) and supports the weight of the press bar 18 by way of brackets 30. The actuator 20 moves the press bar 18 about the brace post 22 so that the press bar 18 may engage or disengage a roll of fencing 200 loaded onto the spindle 16. In the example shown, only one press bar 18 and one actuator 20 are provided. However, it is contemplated that multiple press bars and/or multiple actuators may be utilized without departing from the scope of the present disclosure. Such embodiments may be desired, for example, if multiple rolls are loaded onto the spindle 16, or if a stronger grip is required.

In the example shown, a pair of brackets 30 is used to connect the brace post 22 to the press bar 18, towards the outer edges of the press bar 18. While the brace post 22 is stationary relative to the support frame 14, the pair of brackets 30 allow the press bar 18 to pivot relative to the brace post 22. The brackets 30 may be attached to the brace post 22 by way of a nut 33 and bolt 31 assembly that is welded to the press bar 18, but other attachment methods may also be employed so long as the attachment method provides for rotation relative to the brace post 22.

The press bar 18 of the embodiment of FIGS. 1-7 is shown as having an angled (i.e., L-shaped) body with a spine 26 running along its length. However, the size and shape of the press bar 18 need not be limiting features as press bars of differing sizes and shapes may be employed. In any case, it is generally contemplated that press bars 18 having heights similar or greater to the height of the roll 200 may be preferred because such press bars 18 may evenly distribute tension across the length of the fencing when the press bar 18 presses against the roll of fencing 200.

In an exemplary embodiment, a plurality of teeth 28 may be provided along spine, oriented towards the spindle 16. Thus, when a roll of fencing 200 is loaded onto the spindle 16, the teeth 28 may be used to engage the fencing such that a tight grip against the roll 200 may be established when the press bar 18 is engaged. Accordingly, design features such as the size, shape, and number of the teeth 28, as well as the spacing of the teeth 28 along the length of the press bar 18, need not be limiting and may be varied as needed to accommodate different types of fencing.

Still referring to the embodiment shown in FIGS. 1-7, the actuator 20 may be a linear actuator that is connected to the support frame 14 and the press bar 18. This linear actuator may be configured to move the press bar 18 about the brace post 22. In other embodiments, however, rotational actuators may be employed instead. These rotational actuators may be disposed, for example, along the length of the brace post 22 and configured to move the press bar 18 by rotating the brackets 30 or, in the alternative, may be configured to rotate the brace post 22 in its entirety.

In an exemplary embodiment, the actuator 20 may be a hydraulic cylinder from County Line Equipment Sales, LLC of Vandalia, Mo. Though, a variety of hydraulic cylinders may also be used. Hydraulic hoses 40 may be attached to the hydraulic cylinder via couplers, and connect to the skid steer 210 hydraulic system, thereby allowing the operator of the skid steer 210 to engage the press bar 18 as desired through operation of the auxiliary hydraulic system. The operator may cause actuation of the actuator 20 in a variety of ways, including by operation of one or more controls located on the skid steer 210. The degree to which the press bar 18 is engaged/moved can thereby be dictated by the skid steer operator. This allows the assembly to utilize different size rolls of fencing 200, and provide continued pressure against the fence roll 200 via the press bar 18 as the size of a fence roll 200 decreases during fence installation. In an exemplary embodiment the press bar 18 is able to be engaged along a wide range of movement. The press bar 18 may be able to be extended such that it can come into physical contact with the spindle 16.

In the exemplary embodiment of FIGS. 1-7, the press bar 18 enjoys a range of movement caused by actuation of the actuator 20. In a first position, position A (see FIG. 1), the press bar 18 is located a first distance X from the spindle 16, and oriented in a parallel fashion to the spindle 16. The press bar 18 is not in contact with the roll of fencing 200. In a second position, position B, caused by actuation of the actuator 20, the press bar 18 is located a smaller distance, distance Y, from the spindle 16, placing pressure against the roll of fencing 200, and causing the teeth 28 to engage with the fencing 200. In an engaged position, the pressure of the press bar 18 in conjunction with the engagement of the teeth 28 act to prevent the roll of fencing 200 from rotating around the spindle 16 and being unwound even when the free end of the fencing is pulled. It will be understood by one of ordinary skill in the art that depending on the actuation of the cylinder the positioning of the press bar 18 relative to the spindle 16 can vary.

Figure 8:
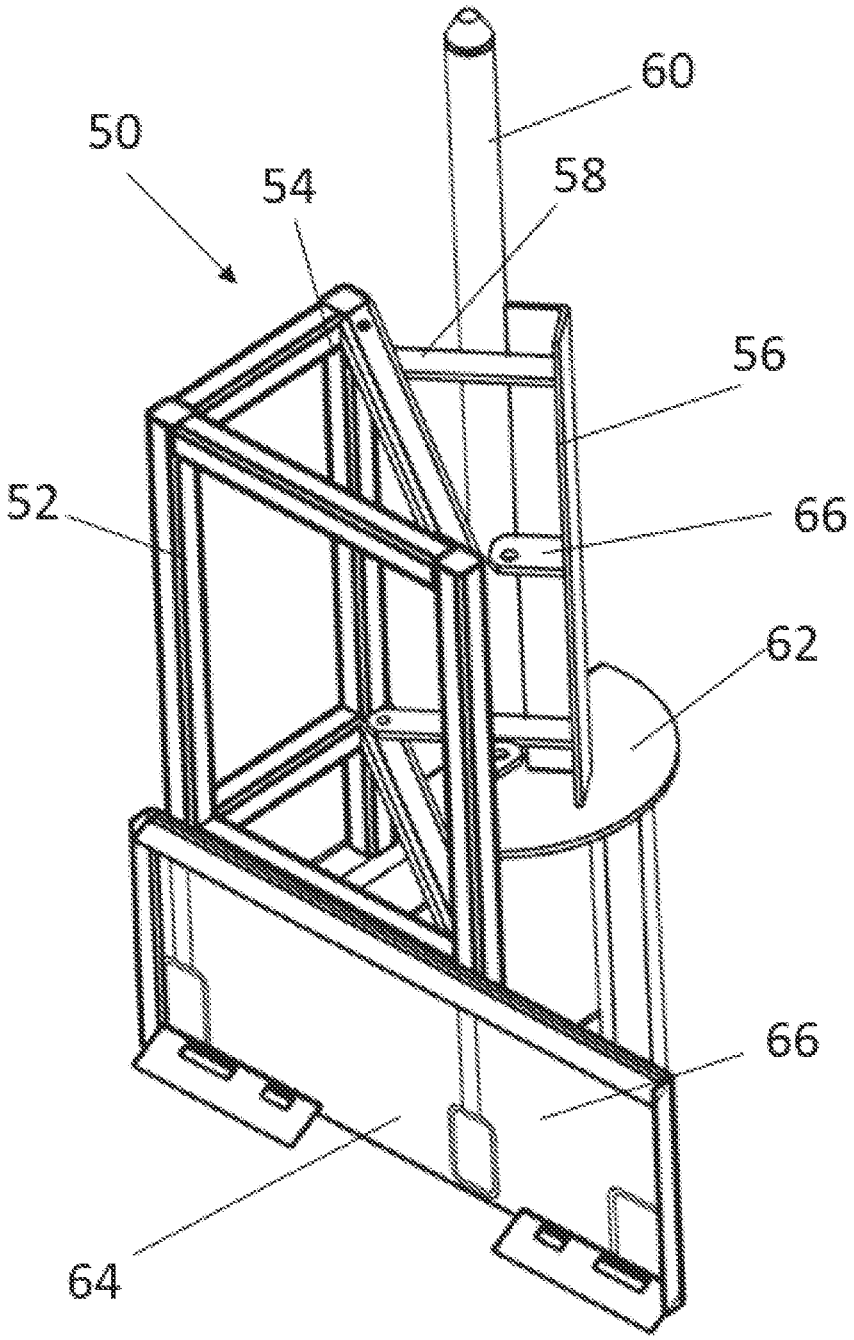
FIG. 8 is a back side perspective view of a second exemplary embodiment of a fence pulling assembly.
Figure 9:
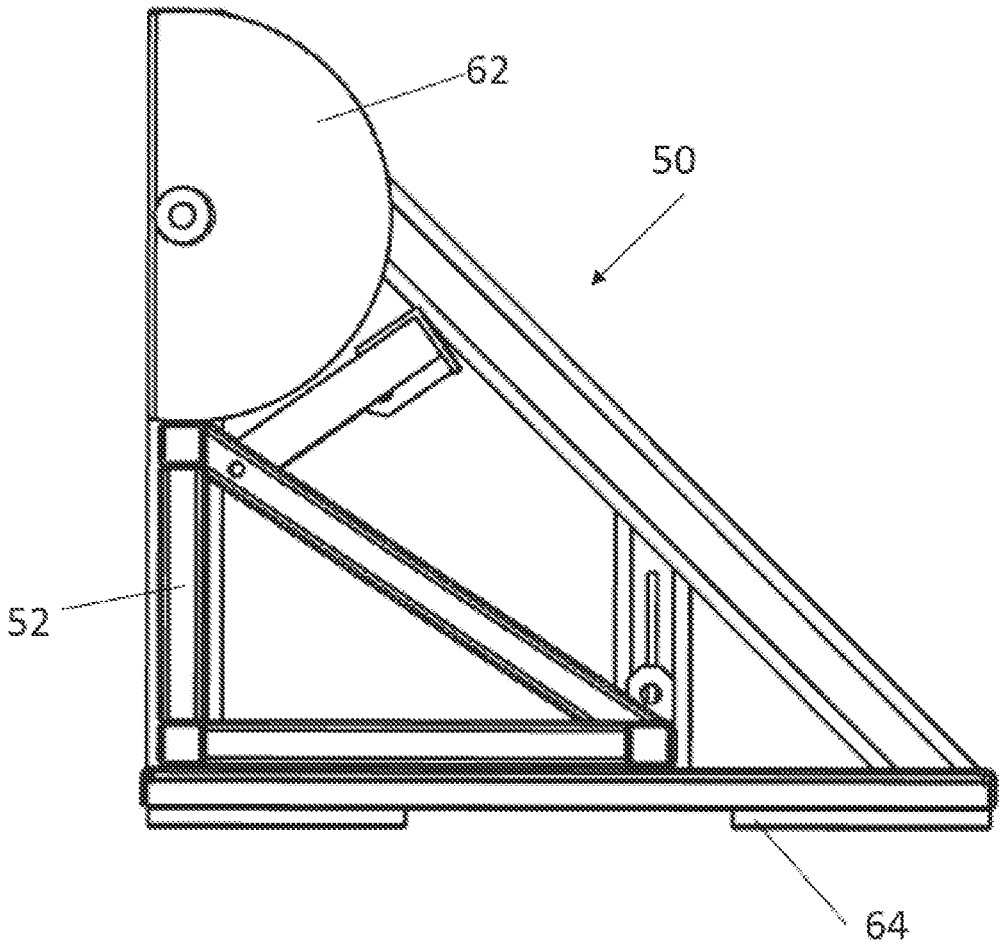
FIG. 9 is a top plan view of the exemplary embodiment of FIG. 8.
Figure 10:
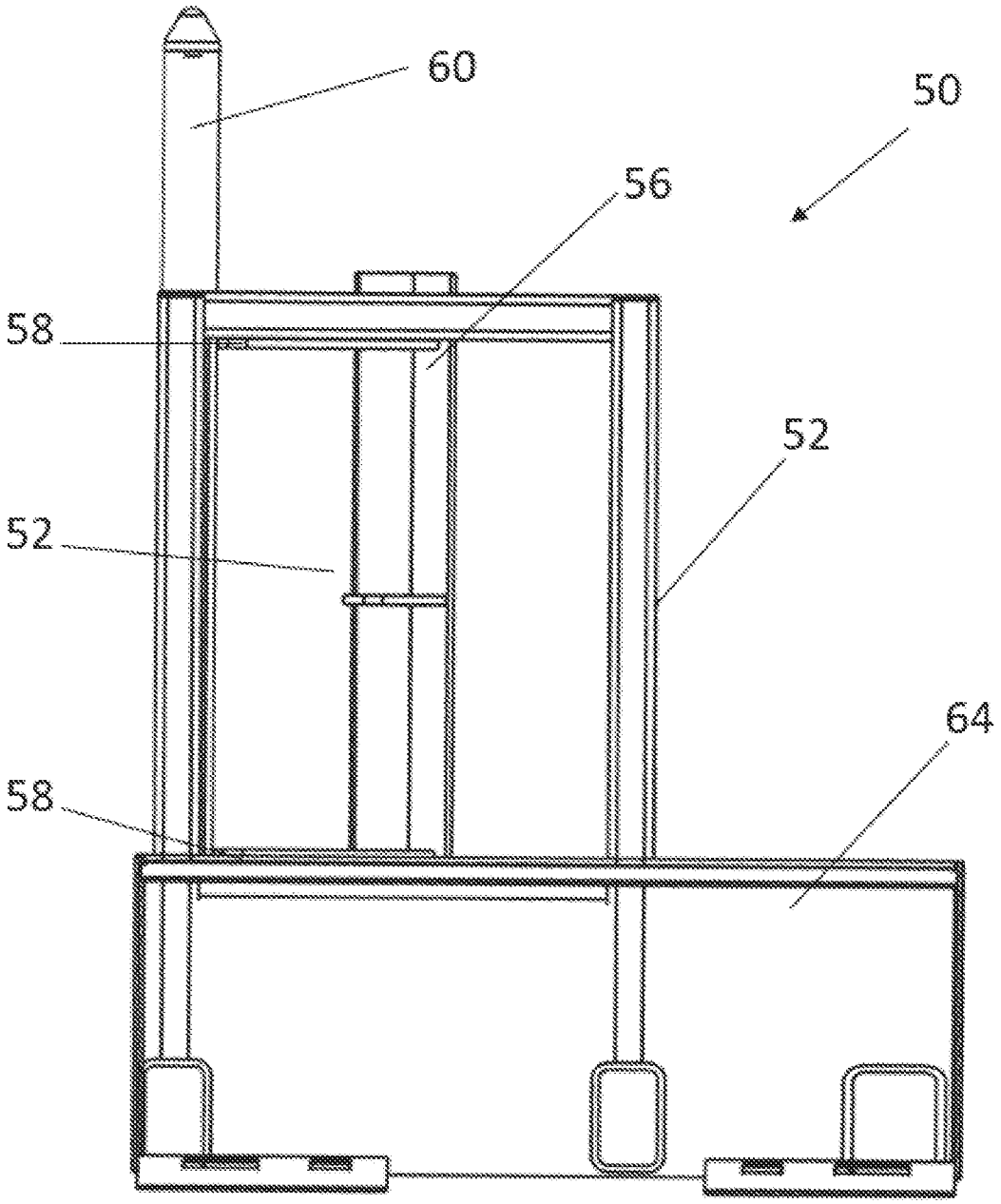
FIG. 10 is a back side view of the exemplary embodiment of FIG. 8.
Figure 11:
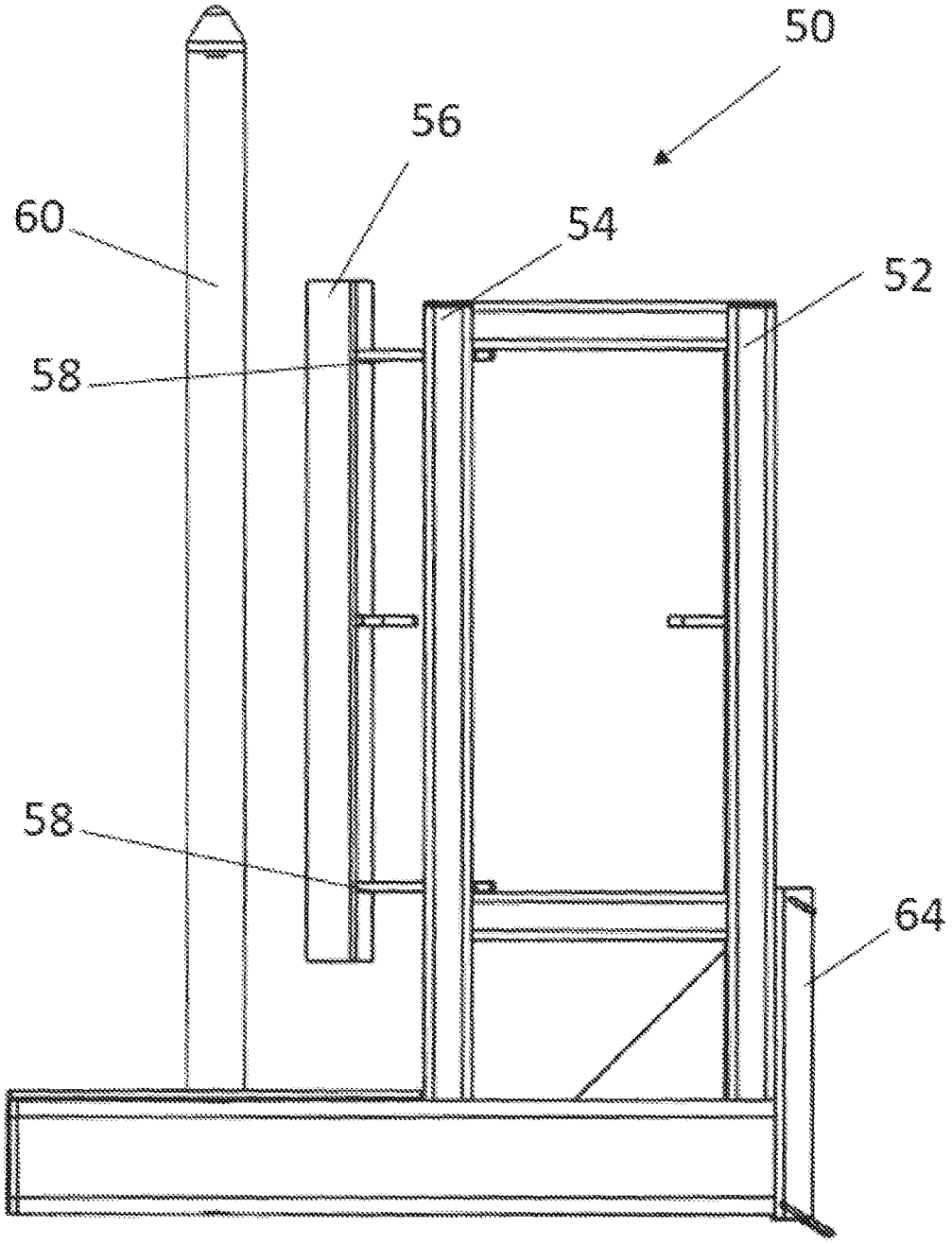
FIG. 11 is a right side environmental view of the exemplary embodiment of FIG. 8.
Figure 12:
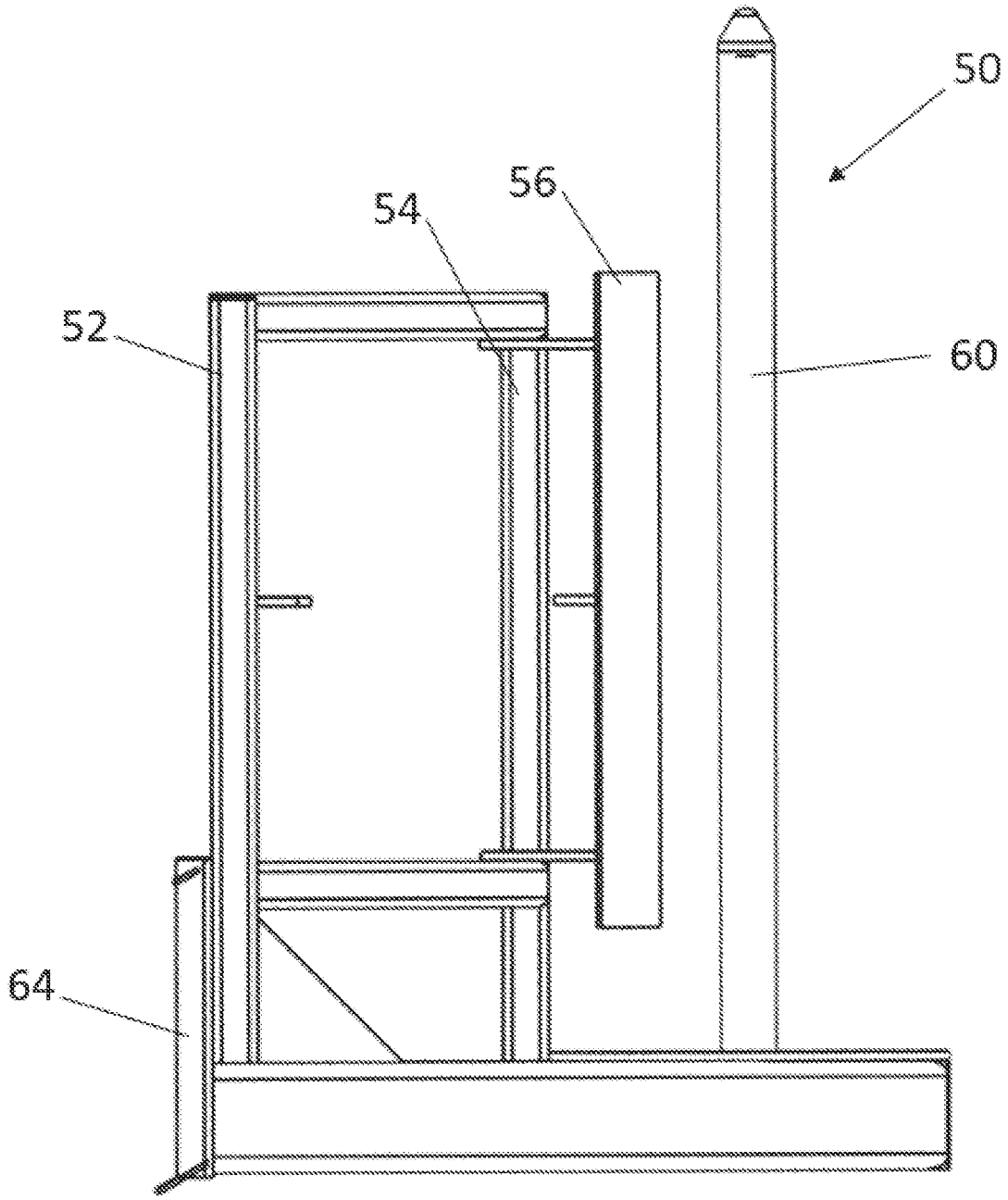
FIG. 12 is a left side environmental view of the exemplary embodiment of FIG. 8.
Figure 13:
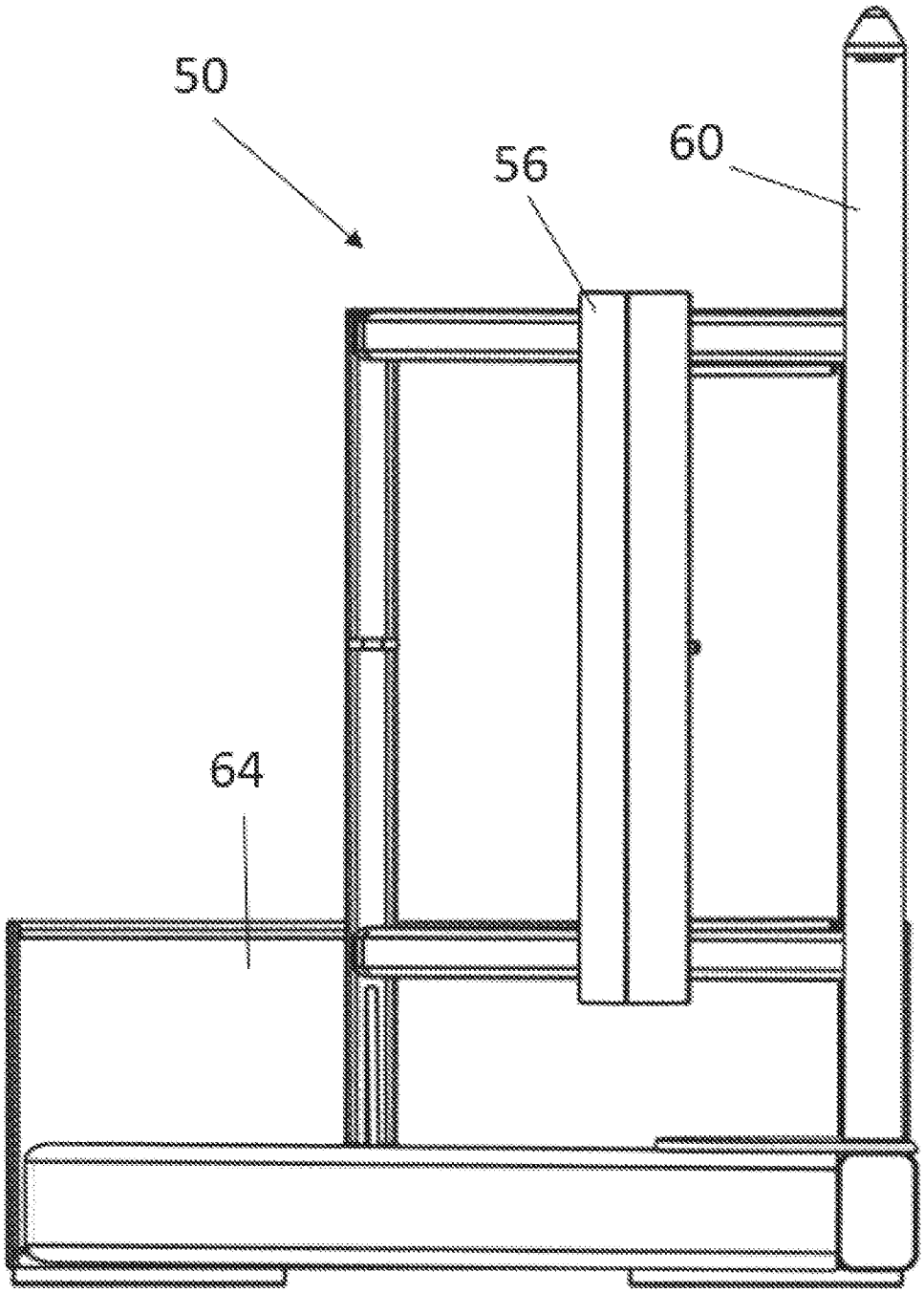
FIG. 13 is a front environmental view of the exemplary embodiment of FIG. 8.
Figure 14:
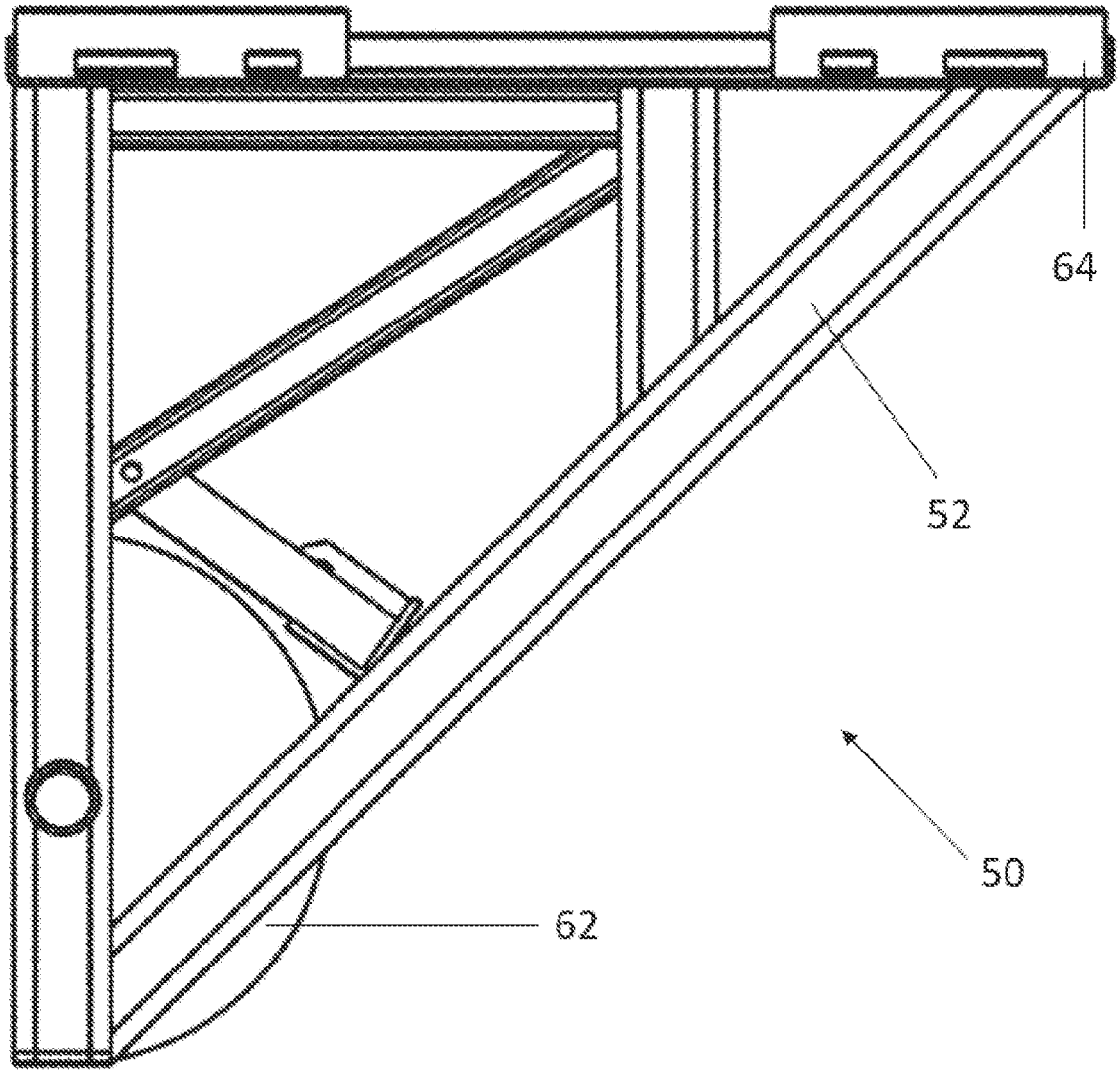
FIG. 14 is a bottom plan view of the exemplary embodiment of FIG. 8.
Figure 15:
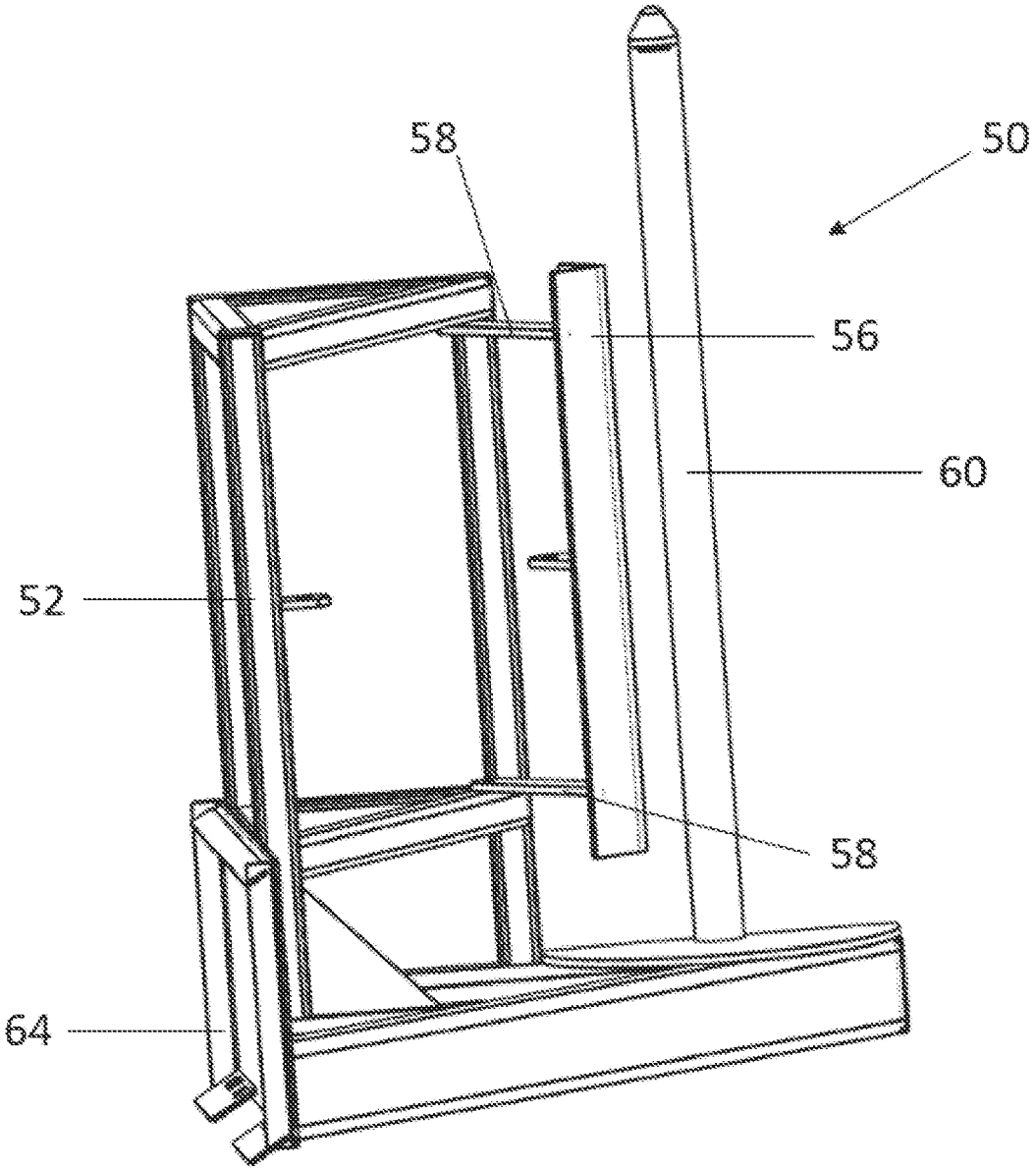
FIG. 15 is a left side perspective view of the exemplary embodiment of FIG. 8.
Figure 16:
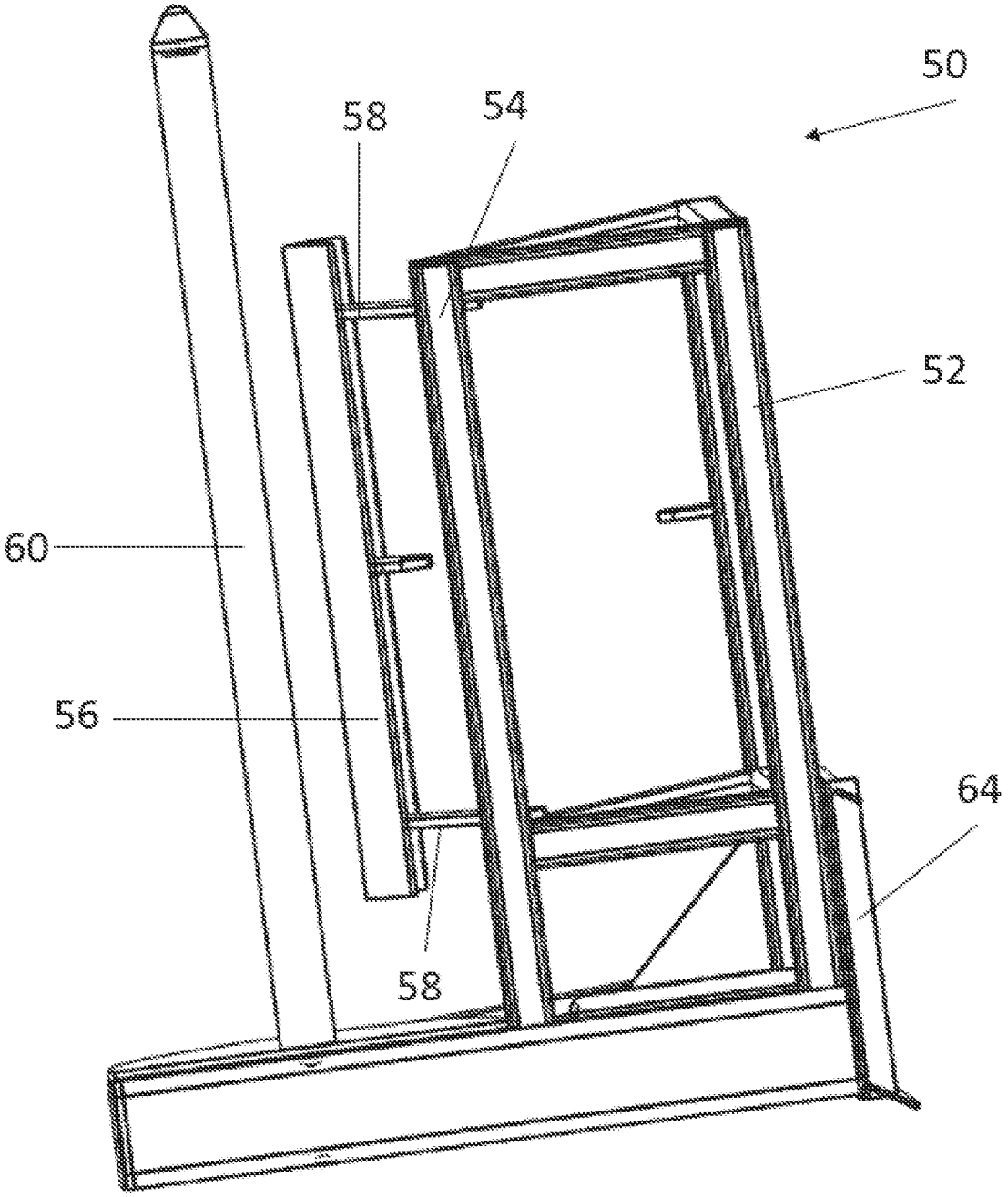
FIG. 16 is a right side perspective view of the exemplary embodiment of FIG. 8.

One of ordinary skill in the art will recognize that the assembly may be manufactured in a variety of different shapes and configurations without departing from the inventive concept. Referring to FIGS. 8-16, a second exemplary embodiment of a fence pulling assembly 50 is shown, with hydraulic cylinder and related hydraulic components omitted. In this embodiment, the support frame 52 has a different shape than that of FIGS. 1-7. A brace post 54 is integrated into the overall support frame 52. The press bar 56 is connected to the brace post 54 of the support frame 52 via two pivoting brackets 58 that allow the press bar 56 to move through a range of positions. A spindle 60 with a flange positioned at the bottom is fixedly attached to the support frame 52. As with the first embodiment, the spindle 60 of the second embodiment is sized to receive a roll of fencing, and hold it in place. The press bar 56, when extended towards the spindle 60, may hold the roll of fencing in a fixed position while the fencing is stretched and/or attached to fence posts or other materials. When the press bar 56 is retracted away from the spindle 60, the roll of fencing is free to rotate around the spindle 60.

The assembly 50 shown in FIGS. 8-16 may be connected to a skid steer via a mount plate 64 connected to the support frame 52. Although not pictured, a hydraulic cylinder may be connected to the press bar 56 via a coupler 66 on the press bar 56. When engaged, the hydraulic cylinder may induce the press bar 56 to pivot relative to the brace post 54 and press into a roll of fencing located on the spindle 60.

The assembly, either in part or in its entirety, may be comprised of metal such as steel or aluminum. However, one of ordinary skill in the art will recognize that a variety of materials may be suitable to construct the various elements of the assembly without departing from the inventive concept.

In operation, exemplary embodiments can be used to lift rolls of fencing (e.g., woven fencing), move the rolls to a desired location, and hold the rolls in a fixed position to allow for stretching/pulling of the fencing and attachment to fence posts or other structures. In an exemplary method using the assembly 10 illustrated in FIGS. 1-7, and as particularly depicted in FIGS. 5-8, the assembly 10 can be used to pick up a roll of fencing 200 off of a surface such as the floor or a truck bed. The assembly 10 is tilted via the skid steer 210, such that the spindle 16 is in a horizontal orientation and can be lined up with the central void in a roll of fencing 200. The assembly 10 is then moved forward in order to insert the spindle 16 through a length of the roll 200, through the central void of the fence roll, and then the assembly 10 is tilted back into an upright position, with the spindle 16 in a vertical orientation, with the fence roll 200 resting on top of the flange 24. The fence roll 200 can then be transported via the skid steer 210 to a desired location.

When the press bar 18 is disengaged, the fence roll is able to rotate freely around the spindle 16 as the fence is unwound. This allows for a roll of fencing 200 to be unwound and the free end or other portion of the fencing to be attached to a first fence post 220 or other surface. The press bar 18 may then be engaged to put pressure on the roll, hold the fence roll 200 in a fixed position, and prevent further rotation around the spindle 16 while the fence is stretched/pulled as the skid steer 210 moves in a direction away from the fence post 220 or other surface. In this manner, the assembly 10 may be used to hold the fence in position while it is attached to a plurality fence posts, stretch the fence between each post, and allow for installation of fencing that is straight and taut. This not only provides an installed woven fence that is visually please, but one that is more effective at preventing animals from leaving or entering the fenced-in area.

One of ordinary skill in the art will recognize that any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

Certain operations described herein may be performed by one or more electronic devices. Each electronic device may comprise one or more processors, electronic storage devices, executable software instructions, and the like configured to perform the operations described herein. The electronic devices may be general purpose computers or specialized computing device. The electronic devices may comprise personal computers, smartphone, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein.

What is claimed is:

1. A fence pulling assembly comprising:

a mount plate comprising a first major side and a second major side, wherein the first major side is configured to interface with a loader;

a support frame fixedly connected to, and extending from, the second major side of the mount plate, wherein the support frame comprises a distal end;

a spindle fixedly connected to, and extending from, the distal end of the support frame, wherein the spindle is positioned off-center relative to the horizontal width of the second major side of the mount plate, and wherein the spindle comprises an open distal end;

a brace post connected to the support frame;

a press bar that is pivotable about the brace post between at least a first position and a second position, wherein the distance between the press bar and the spindle is greater in the first position than in the second position; and an actuator configured to move the press bar between at least the first position and the second position.

2. The fence pulling assembly of claim 1, wherein the mount plate and the support frame comprise a substantially triangular configuration.

3. The fence pulling assembly of claim 1 further comprising a flange disposed along the base of the spindle.

4. The fence pulling assembly of claim 3 wherein the flange is rotatable around the base of the spindle.

5. The fence pulling assembly of claim 1, wherein the brace post, the press bar, and the spindle are oriented substantially parallel to one another.

6. The fence pulling assembly of claim 1 further comprising a bracket connected to the press bar and to the brace post.

7. The fence pulling assembly of claim 6, wherein the bracket is connected to the brace post by a nut and bolt assembly that allows for rotational movement of the bracket about the brace post.

8. The fence pulling assembly of claim 1 further comprising a roll of fencing, wherein:

the roll of fencing comprises a height;

the press bar comprises a height; and the height of the roll of fencing is similar to the height of the press bar.

9. The fence pulling assembly of claim 1, wherein the actuator comprises a linear actuator.

10. The fence pulling assembly of claim 9, where in the linear actuator comprises a hydraulic cylinder.

11. The fence pulling assembly of claim 1, wherein the press bar comprises a spine and a plurality of teeth spaced apart along the spine.

12. The fence pulling assembly of claim 1, wherein the brace post is integrated into the support frame.

13. The fence pulling assembly of claim 1, wherein the press bar comprises a coupler configured to couple the press bar to an actuator.

14. A fence pulling assembly comprising:

a mount plate comprising a first major side and a second major side, wherein the first major side is configured to interface with a loader;

a support frame fixedly connected to, and extending from, the second major side of the mount plate, wherein the support frame comprises a distal end;

a spindle fixedly connected to, and extending from, the distal end of the support frame, wherein the spindle is positioned off-center relative to the horizontal width of the second major side of the mount plate, and wherein the spindle comprises an open distal end;

a brace post connected to the support frame;

a press bar hingedly connected to the brace post by at least one bracket, wherein the press bar is pivotable about the brace post between at least a first position and a second position, and wherein the distance between the press bar and the spindle is greater in the first position than in the second position; and a linear hydraulic cylinder hingedly connected to the support frame at one end and hingedly connected to the press bar at the other end, wherein the linear hydraulic cylinder is configured to move the press bar between at least the first position and the second position.

15. The fence pulling assembly of claim 14 wherein the press bar comprises a plurality of teeth oriented towards the spindle.

16. A fence pulling assembly comprising:

a mount plate comprising a first major side and a second major side, wherein the first major side is configured to interface with a loader, and wherein the second major side comprises a right-side periphery and a left-side periphery;

a support frame member fixedly connected to, and extending from, either the right-side periphery or the left-side periphery of the second major side, wherein the support frame member comprises a distal end;

a spindle fixedly connected to, and extending from, the distal end of the support frame member, wherein the spindle comprises an open distal end;

a brace post connected to the support frame member;

a press bar that is pivotable about the brace post between at least a first position and a second position, wherein the distance between the press bar and the spindle is greater in the first position than in the second position; and an actuator configured to move the press bar between at least the first position and the second position.

* * * * *